US008025610B2

(12) United States Patent
Chang

(10) Patent No.: US 8,025,610 B2
(45) Date of Patent: Sep. 27, 2011

(54) SAFETY DEVICE FOR ELLIPTICAL EXERCISE MACHINES

(75) Inventor: Yao-Jen Chang, Taichung (TW)

(73) Assignee: Rexon Industrial Corp., Ltd, Taichung (TW)

( * ) Notice: Subject to any disclaimer, the term of this patent is extended or adjusted under 35 U.S.C. 154(b) by 3 days.

(21) Appl. No.: 12/711,605

(22) Filed: Feb. 24, 2010

(65) Prior Publication Data

US 2010/0216604 A1 Aug. 26, 2010

(30) Foreign Application Priority Data

Feb. 26, 2009 (TW) ..... 98106183 A

(51) Int. Cl.
*A63B 22/04* (2006.01)

(52) U.S. Cl. ..... 482/52; 70/233

(58) Field of Classification Search ..... 482/51, 482/52, 54, 57, 63; 601/29, 32, 33, 34, 35, 601/36; 70/33, 226, 233; 188/31, 265; 135/67, 135/85

See application file for complete search history.

(56) References Cited

U.S. PATENT DOCUMENTS

| | | | | |
|---|---|---|---|---|
| 2,009,862 | A * | 7/1935 | Spell | 188/31 |
| 4,384,713 | A * | 5/1983 | Deutsch et al. | 482/68 |
| 5,031,901 | A * | 7/1991 | Saarinen | 482/63 |
| 5,133,201 | A * | 7/1992 | LaMott et al. | 70/226 |
| 5,202,539 | A * | 4/1993 | Lamb | 187/254 |
| 6,338,355 | B1 * | 1/2002 | Cheng | 135/67 |
| 7,004,888 | B1 * | 2/2006 | Weng | 482/57 |
| 2005/0003934 | A1 * | 1/2005 | Wu | 482/64 |
| 2005/0020410 | A1 * | 1/2005 | Chang | 482/63 |
| 2005/0159274 | A1 * | 7/2005 | Chen | 482/63 |

FOREIGN PATENT DOCUMENTS

| | | |
|---|---|---|
| CN | 2513621 Y | 10/2002 |
| TW | 236874 | 1/1983 |
| TW | 551198 | 2/1991 |
| TW | 551198 Y | 9/2003 |

OTHER PUBLICATIONS

Office Action issued in Chinese application 200910126406.3, dated Nov. 12, 2010.

* cited by examiner

*Primary Examiner* — Loan Thanh
*Assistant Examiner* — Tam Nguyen
(74) *Attorney, Agent, or Firm* — Bacon & Thomas, PLLC

(57) ABSTRACT

A safety device for use with an elliptical exercise machine includes a holder frame, a movable member, a locking member, and an operating member. The holder frame is fixedly mounted in the elliptical exercise machine at a predetermined selected location. The movable member is movably mounted in the elliptical exercise machine. The locking member is movably mounted in the holder frame in order to selectively lock the movable member from moving. The operating member is operable to move the locking member. A user can lock the movable member of the elliptical exercise machine after each exercise. When the user uses the elliptical exercise machine again and steps on the pedals of the elliptical exercise machine before starting to exercise, the user will not accidentally fall from the elliptical exercise machine due to an unexpected displacement of the center of gravity.

8 Claims, 9 Drawing Sheets

SAFETY DEVICE FOR ELLIPTICAL EXERCISE MACHINES

This application claims, under 35 U.S.C. §119, priority to Taiwanese Application No. 098106183, filed Feb. 26, 2009, which application is hereby incorporated by reference herein in its entirety, inclusive of its specification, claims, and drawings.

FIELD OF THE INVENTION

The present invention relates to physical exercising machines and more particularly, to a safety device for use with elliptical exercise machines.

BACKGROUND

Elliptical exercise machines are common machines used for physical exercises. Such machines generally have two pedals and two handlebars connected with the pedals for holding by the user while stepping on the pedals. When using the elliptical exercise machine, the user steps on the pedals and hold the handlebars with the hands, and then the user can simultaneously move their hands and legs, causing the pedals to be moved back and forth along the designed motion track.

According to the conventional design, the user can start to exercise when stepping on the pedals of the elliptical exercise machine. However, when the user steps on the pedals before starting to exercise, the pedals will be forced to move under the weight of the user. The sudden displacement of the pedals may cause the user to accidentally fall from the pedals.

There are commercial elliptical exercise machines with brake mechanisms. However, when either friction type or electromagnetic type brake mechanisms are used, the pedals will still be forced to move when the user steps on the pedals with sufficient force to overcome the brake mechanism, and there still exists the risk of a falling accident.

SUMMARY

The disclosed embodiments of the present invention have been accomplished in view of the circumstances discussed above. Accordingly, the disclosed embodiments provide a safety device for use in an elliptical exercise machine, which allows the user to lock the two pedals of the elliptical exercise machine after each use so that a next user will not accidentally fall from the elliptical exercise machine when stepping on the pedals before starting to exercise.

In general, a safety device for use in an elliptical exercise machine is disclosed, having a holder frame, an actuation chamber, a movable member, a locking member, an operating member, at least one spring member, and a positioning device. The holder frame is fixedly mounted in the elliptical exercise machine at a predetermined selected location. The actuation chamber is defined in the holder frame, having an opening in communication with the space outside the holder frame. The movable member is movably mounted in the elliptical exercise machine adjacent to the actuation chamber and is movable, subject to operation of the elliptical exercise machine by a user. The locking member is mounted in the actuation chamber, having an outer end thereof movable into and out of the opening of the moveable member for selectively locking the movable member from moving. The operating member is disposed outside of the actuation chamber and is connected to the locking member and operable to move the locking member between locked and unlocked positions. The at least one spring member is mounted in the actuation chamber and is adapted for imparting a spring pressure to bias the locking device in a direction away from the opening of the actuation chamber (the unlocked position). The positioning device is disposed on the outside of the actuation chamber for securing the operating member.

Thus, the user can selectively lock the pedals of the elliptical exercise machine after each exercise. When a subsequent or the same user uses the elliptical exercise machine again and steps on the pedals of the elliptical exercise machine before starting to exercise, the user will not accidentally fall from the elliptical exercise machine due to a sudden, unexpected displacement of the center of gravity, due to the sudden, unexpected movement of the pedals.

In an alternate embodiment, the safety device includes a holder frame, a movable member, a locking member, and an operating member. The holder frame is fixedly mounted in the elliptical exercise machine at a predetermined selected location. The movable member is movably mounted in the elliptical exercise machine and is movable, subject to operation of the elliptical exercise machine by a user. The locking member is movably mounted in the holder frame, and is adapted for selectively locking the movable member from moving. The operating member has a first end and a second end opposite to the first end. The second end of the operating member is connected with the locking member. The first end of the operating member is pivotally connected to the holder frame. Thus, the second end is rotatable about the axis of the first end to move the locking member between locked and unlocked positions.

Thus, the user can rotate the second end of the operating member about the axis of the first end of the operating member, selectively moving the locking device into engagement with a locating device on the movable member. Thus, the movable member and the pedals of the elliptical exercise machine are locked. Accordingly, when a subsequent or the same user steps on the pedals before starting to exercise, the user will not accidentally fall from the pedals.

In a variation, the safety device further includes a rotating shaft pivotally mounted in the elliptical exercise machine adjacent to the movable member and rotatable by an external force, and a connection member wound around the rotating shaft. The connection member has one end thereof fixedly connected to the operating member and an opposite end thereof fixedly connected to the rotating shaft. Further, the rotating shaft can be an electrically rotatable shaft or a manually rotatable shaft.

The safety device further comprises an actuation chamber defined in the holder frame. The actuation chamber has an opening in communication with the space outside the holder frame. Further, the locking member is movably mounted in the actuation chamber, having one end thereof movable into and out of the opening of the actuation chamber between unlocked and locked positions.

Further, the movable member has at least one locating device for selectively receiving the end of the locking member. Further, each locating device can be in the form of a groove or a pinhole. The locking member can be a rod member for selectively engaging one groove or a pin member for selectively engaging one pinhole.

By using embodiments of the disclosed safety device a user is prevented from accidentally falling from the pedals of the exercise machine before starting to exercise.

DETAILED DESCRIPTION

Figure 1:
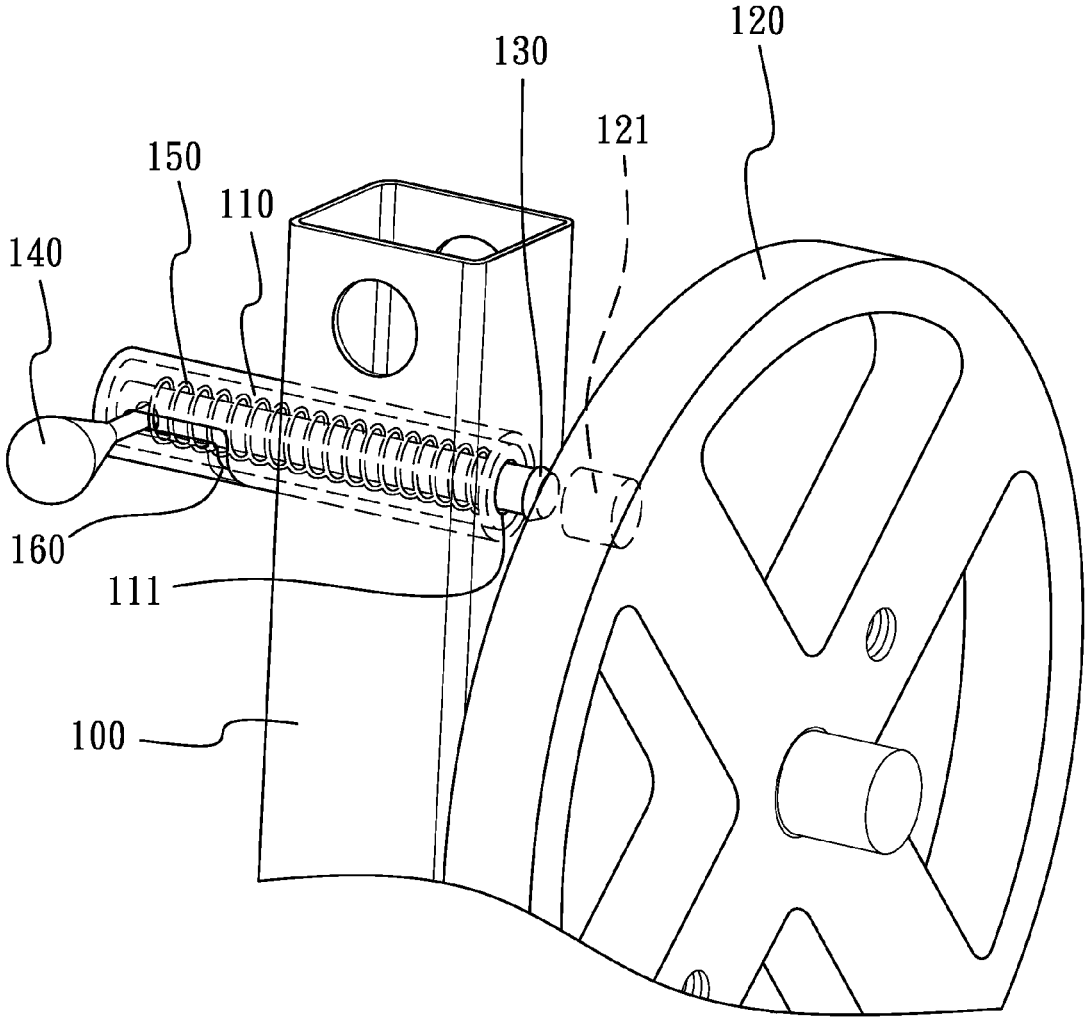
FIG. 1 is a perspective view of a safety device for use with elliptical exercise machines in accordance with a first embodiment of the present disclosure.

Referring to FIG. 1, a safety device for use with elliptical exercise machines in accordance with a first embodiment of the present disclosure is shown comprising a holder frame 100, an actuation chamber 110, a movable member 120, a locking member 130, an operating member 140, a spring member 150, and a positioning device 160.

The holder frame 100 is fixedly mounted in an elliptical exercise machine (not shown) at a suitable location, for example, at or on a support between two pedals of the elliptical exercise machine.

The actuation chamber 110 is defined in the holder frame 100, having an opening 111 in communication with the space outside the holder frame 100.

The movable member 120 is movably mounted on the elliptical exercise machine adjacent to the actuation chamber 110. According to this embodiment, the movable member 120 is a transmission wheel adapted for driving the two pedals of the elliptical exercise machine. Further, the movable member 120 has a locating device 121 formed therein. According to this embodiment, the locating device 121 is a groove.

The locking member 130 is a rod member movably mounted within the actuation chamber 110, having one end thereof movable into and out of the opening 111 of the actuation chamber 110 for selectively engaging the locating device 121 of the movable member 120 and the other end thereof connected with the operating member 140.

The operating member 140 is disposed outside of the actuation chamber 110, having a first end fixedly connected with the locking member 130 and a second end suspended outside of the actuation chamber 110 for operation by a user to move the locking member 130 into engagement with the locating device 121 of the movable member 120 in order to selectively lock the movable member 120 from moving.

The spring member 150 is mounted within the actuation chamber 110 between the operating member 140 and a stop part of the actuation chamber 110 at the inner side of the opening 111 to impart a pressure to the operating member 140 to bias the locking member 130 in a direction away from the opening 111 (the unlocked position).

The positioning device 160 is disposed on the outside of the actuation chamber 110 for holding the operating member 140 in the locked or unlocked position. The positioning device 160 is formed as a generally L-shaped slot along the exterior of the actuation chamber 110.

Figure 2:
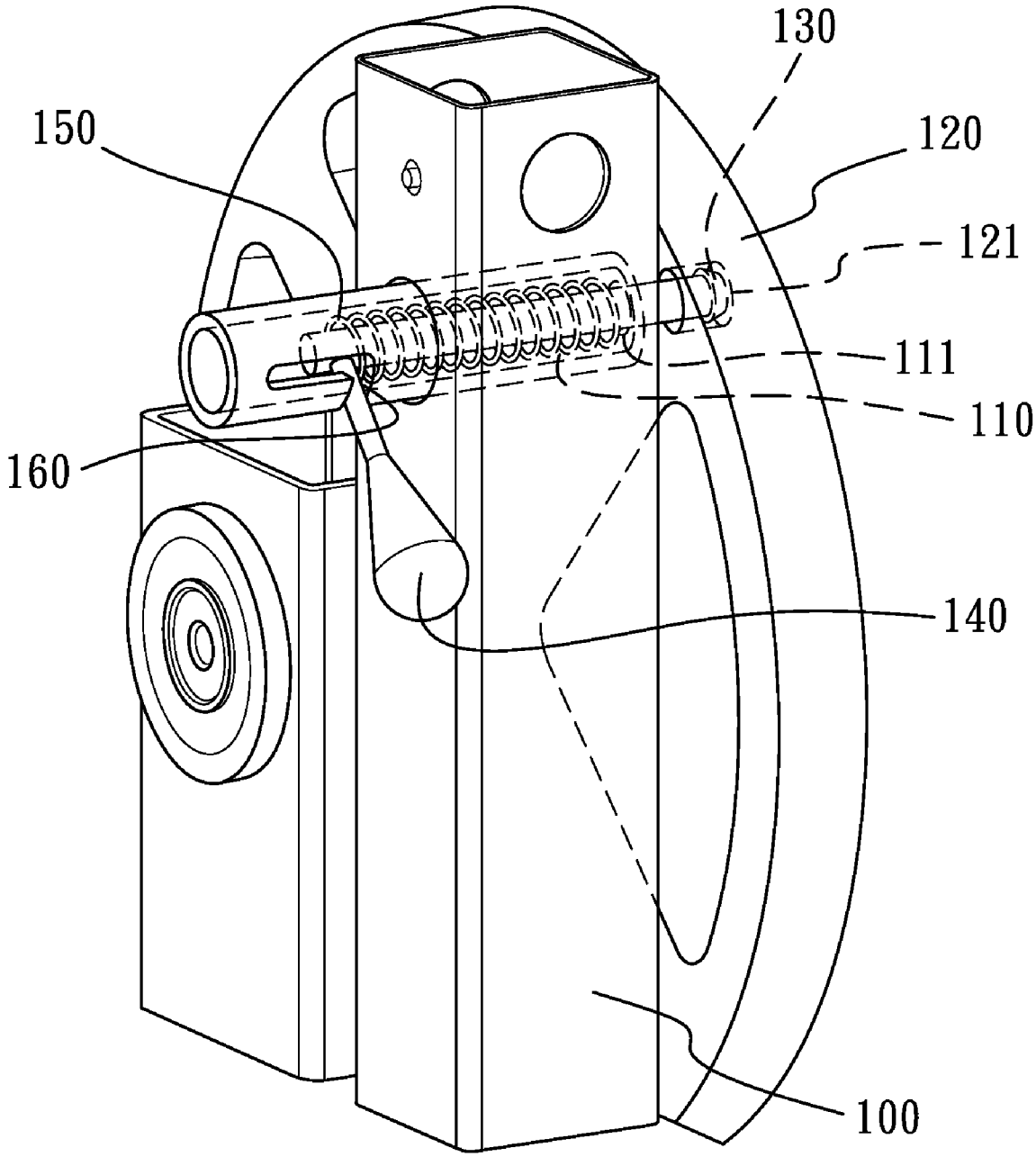
FIG. 2 is a sectional view of the first embodiment of FIG. 1, showing the safety device in the locked position.

Referring to FIG. 2 and FIG. 1, after a use of the elliptical exercise machine, the movable member 120 of the elliptical exercise machine is in a normal, movable position (see FIG. 1). At this time, the user can manipulate the operating member 140 to move the locking member 130 in a direction toward the opening 111 of the actuation chamber 110, thereby compressing the spring member 150 and forcing the locking member 130 into engagement with the locating device 121 of the movable member 120 (thus locking the movable member 120 from movement).

Further, the operating member 140 can be moved within the slot of the positioning device 160, and into the short portion thereof, thus holding the locking member 130 in engagement with the locating device 121 of the movable member 120 and holding the spring member 150 in the compressed condition. Therefore, in this locked position, the movable member 120 is locked from further movement (see FIG. 2).

When the movable member 120 is locked from movement, the two pedals of the elliptical exercise machine are also locked. Thus, when a subsequent user steps onto the pedals of the elliptical exercise machine at this time, the subsequent user will not accidentally fall from the pedals of the exercise machine. When a person is going to use this elliptical exercise machine, they need only to move the operating member 140 away from the short portion of the positioning device 160, thus enabling the biasing force of the spring member 150 to push the operating member 140 back to its former (unlocked) position, thereby disengaging the locking member 130 from the locating device 121 of the movable member 120. At this time, the elliptical exercise machine is now unlocked and operable.

Figure 3:
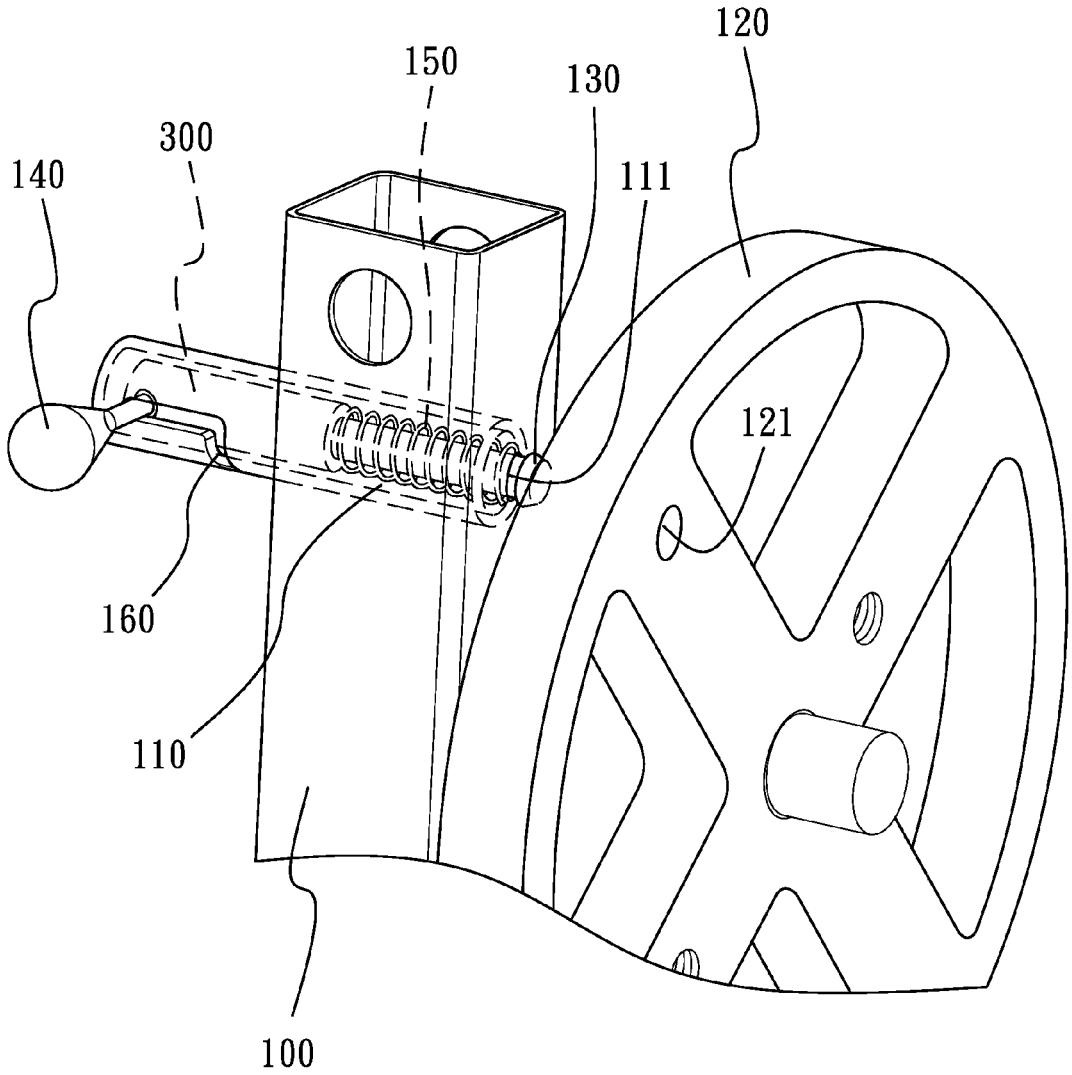
FIG. 3 is a perspective view of a safety device for use with elliptical exercise machines in accordance with a second embodiment of the present disclosure.

FIG. 3 shows a safety device for use with elliptical exercise machines in accordance with a second embodiment of the present disclosure. This second embodiment is substantially similar to the aforesaid first embodiment with the exception that the safety device of this second embodiment further includes a push member 300 movably mounted within the actuation chamber 110.

The push member 300 has one end connected to the locking member 130. The spring member 150 is positioned between the push member 300 and a stop part of the actuation chamber 110, and has one end thereof stopped against the push member 300 and the other end thereof stopped against the stop part of the actuation chamber 110 at the inner side of the opening 111.

The operating member 140 is disposed outside of the actuation chamber 110 and is connected with the push member 300 for moving the locking member 130 into selective engagement with the locating device 121 of the movable member 120. According to this embodiment, the locating device 121 is a pinhole formed through the moveable member 120. By way of the connection between the push member 300 and the locking member 130, the user can operate the operating member 140 to smoothly lock the movable member 120 from moving.

Figure 4:
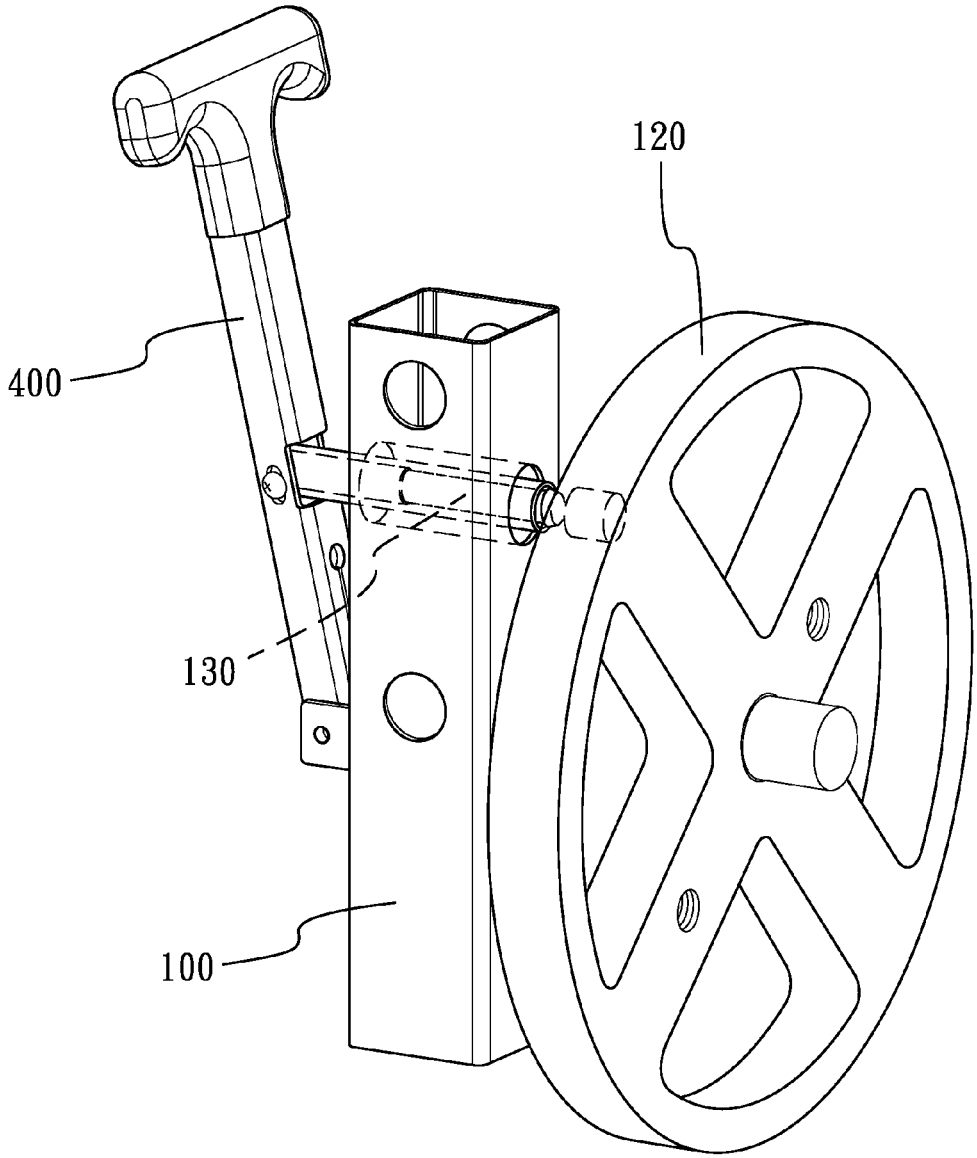
FIG. 4 is a perspective view of a safety device for use with elliptical exercise machines in accordance with a third embodiment of the present disclosure.

Referring to FIG. 4, a safety device for use with elliptical exercise machines in accordance with a third embodiment of the present disclosure is shown having a holder frame 100, a movable member 120, a locking member 130 and an operating member 400.

The holder frame 100 is fixedly mounted in an elliptical exercise machine (not shown) at a suitable location, for example, on or at a support between two pedals of the elliptical exercise machine. The locking member 130 is movably mounted within the holder frame 100.

The operating member 400 has a first end thereof pivotally connected to the holder frame 100, a second end thereof rotatable about the axis of the first end, and a middle part between the first end and the second end coupled to one end of the locking member 130. Therefore, rotating the second end of the operating member 400 can axially move the locking member 130. The movable member 120 is movably mounted in the elliptical exercise machine and is selectively lockable from moving by the locking member 130. After each use, the user can use the locking member 130 to lock the movable member 120 from moving in order to prevent accidental falls.

Figure 5:
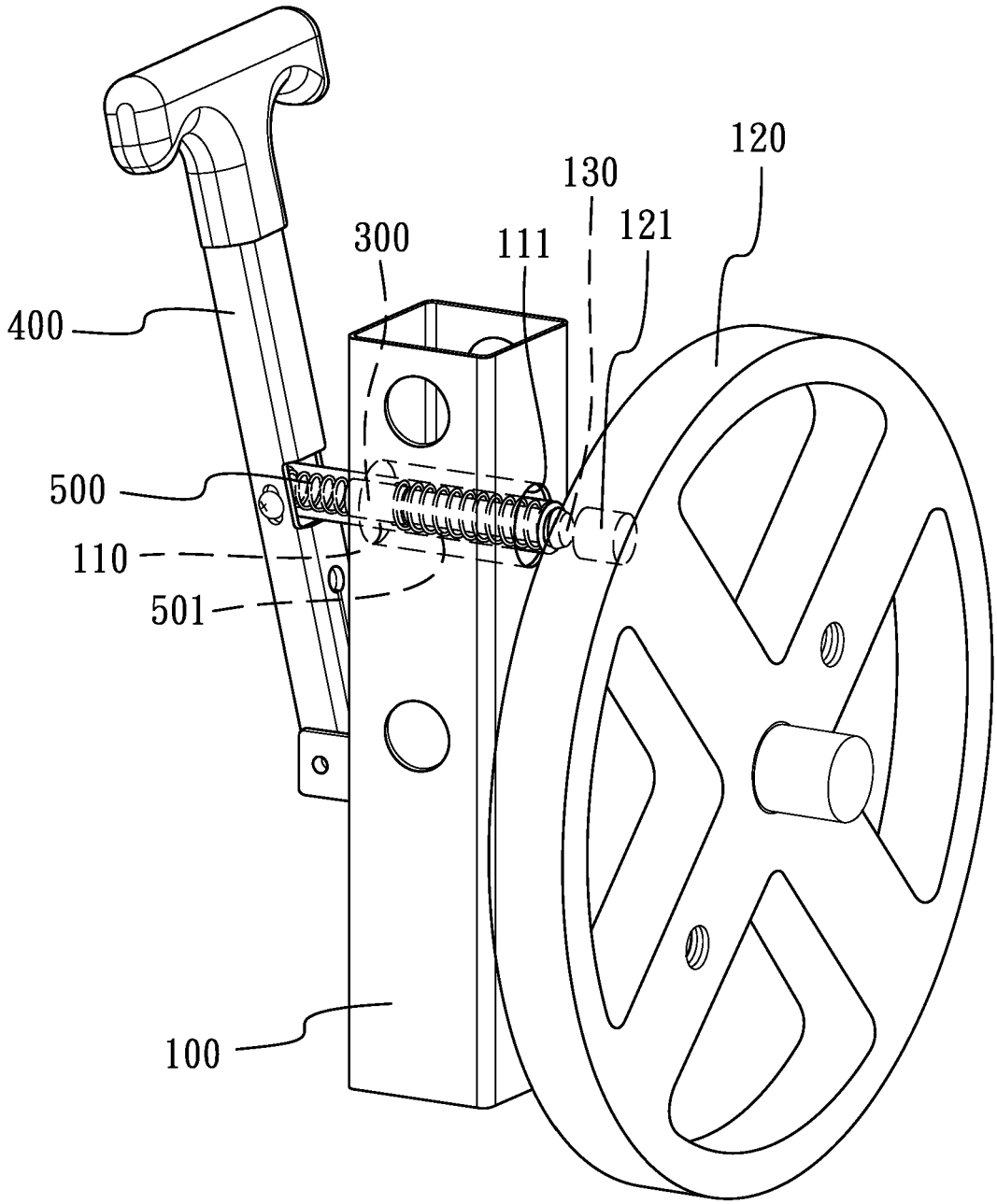
FIG. 5 is a perspective view of a safety device for use with elliptical exercise machines in accordance with a fourth embodiment of the present disclosure.

FIG. 5 illustrates a safety device for use with elliptical exercise machines in accordance with a fourth embodiment of the present disclosure. This fourth embodiment is substantially similar to the aforesaid third embodiment with the exception that the safety device of this fourth embodiment includes the actuation chamber 110, the locating device 121, a push member 300, a first spring member 500, and a second spring member 501.

The actuation chamber 110 is defined in the holder frame 100, having an opening 111 in communication with the space outside of the holder frame 100. The push member 300 is accommodated within the actuation chamber 110, having a first end connected with the locking member 130 and a second end engaged with a first end of the first spring member 500, which has a second end engaged with the operating member 400. The second spring member 501 has a first end engaged with the push member 300 and a second end in contact with a stop part of the actuation chamber 110 at the inner side of the opening 111. The locating device 121 is a groove located on the movable member 120.

Thus, the operating member 400 can be operated to move the first spring member 500 toward the push member 300 and to move the locking member 130 into engagement with the locating device 121. When the user wishes to use the elliptical exercise machine, the return spring force of the second spring member 501 smoothly carries the locking member 130 away from the locating device 121.

Figure 6:
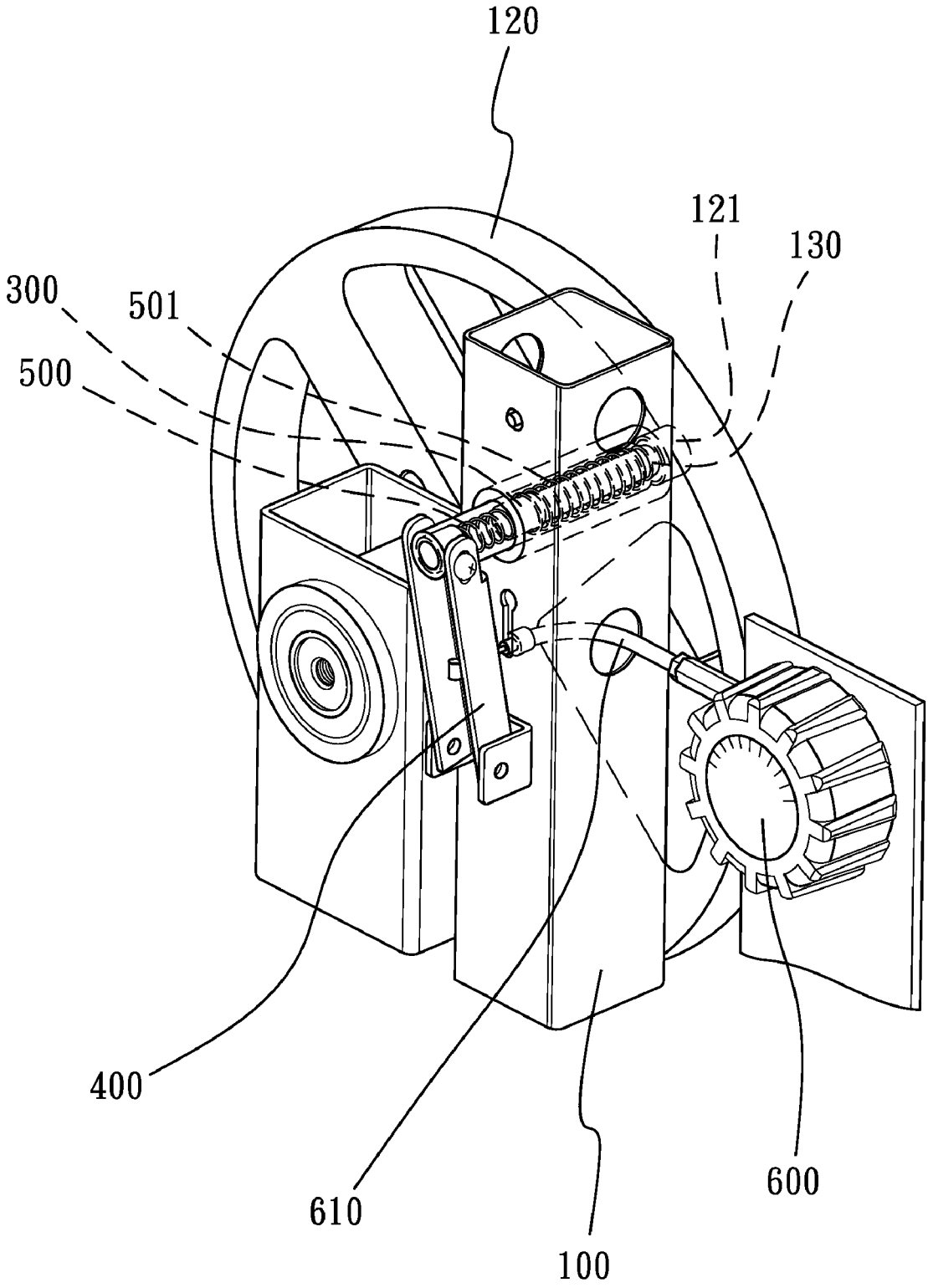
FIG. 6 is a perspective view of a safety device for use with elliptical exercise machines in accordance with a fifth embodiment of the present disclosure.

FIG. 6 illustrates a safety device for use with elliptical exercise machines in accordance with a fifth embodiment of the present disclosure. This fifth embodiment is substantially similar to the aforesaid fourth embodiment with the exception that the safety device of this fifth embodiment further includes a rotating shaft 600 and a connection member 610. The rotating shaft 600 is mounted on the elliptical exercise machine adjacent to the movable member 120. The connection member 610 has a first one end fixedly connected to the operating member 400 and a second end fixedly connected to the rotating shaft 600. Further, the connection member 610 is wound around the rotating shaft 600. The rotating shaft 600 is rotatable by hand (for example, by way of a manual control knob) to take up the connection member 610. When the connection member 610 is taken up, the operating member 400 is thus moved to force the locking member 130 into engagement with the locating device 121 in order to lock the movable member 120 from moving. When the rotating shaft 600 is rotated in the opposite direction, the connection member 610 is unwound, and the biasing force of the second spring member 501 returns the operating member 400 and the locking member 130 to an unlocked position.

Figure 7:
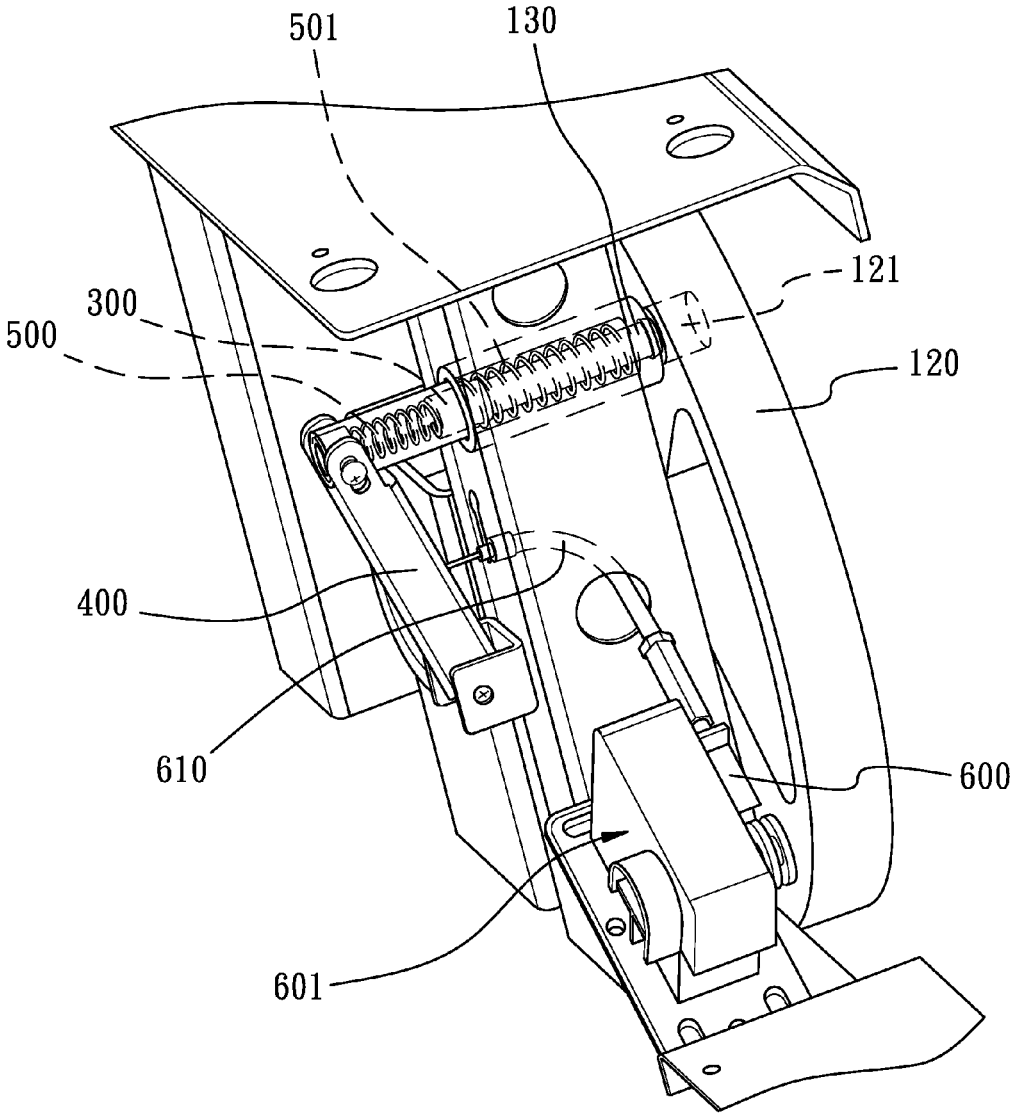
FIG. 7 is a perspective view of a safety device for use with elliptical exercise machines in accordance with a sixth embodiment of the present disclosure.

FIG. 7 illustrates a safety device for use with elliptical exercise machines in accordance with a sixth embodiment of the present disclosure. This sixth embodiment is substantially similar to the aforesaid fifth embodiment with the exception that the safety device of this sixth embodiment uses an electric motor 601 to rotate the rotating shaft 600 in taking up and unwinding the connection member 610, thereby moving the operating member 400 to force the locking member 130 into and out of engagement with the locating device 121. Thus, this embodiment can lock and unlock the movable member 120 automatically by operation of the electric motor 601.

Figure 8:
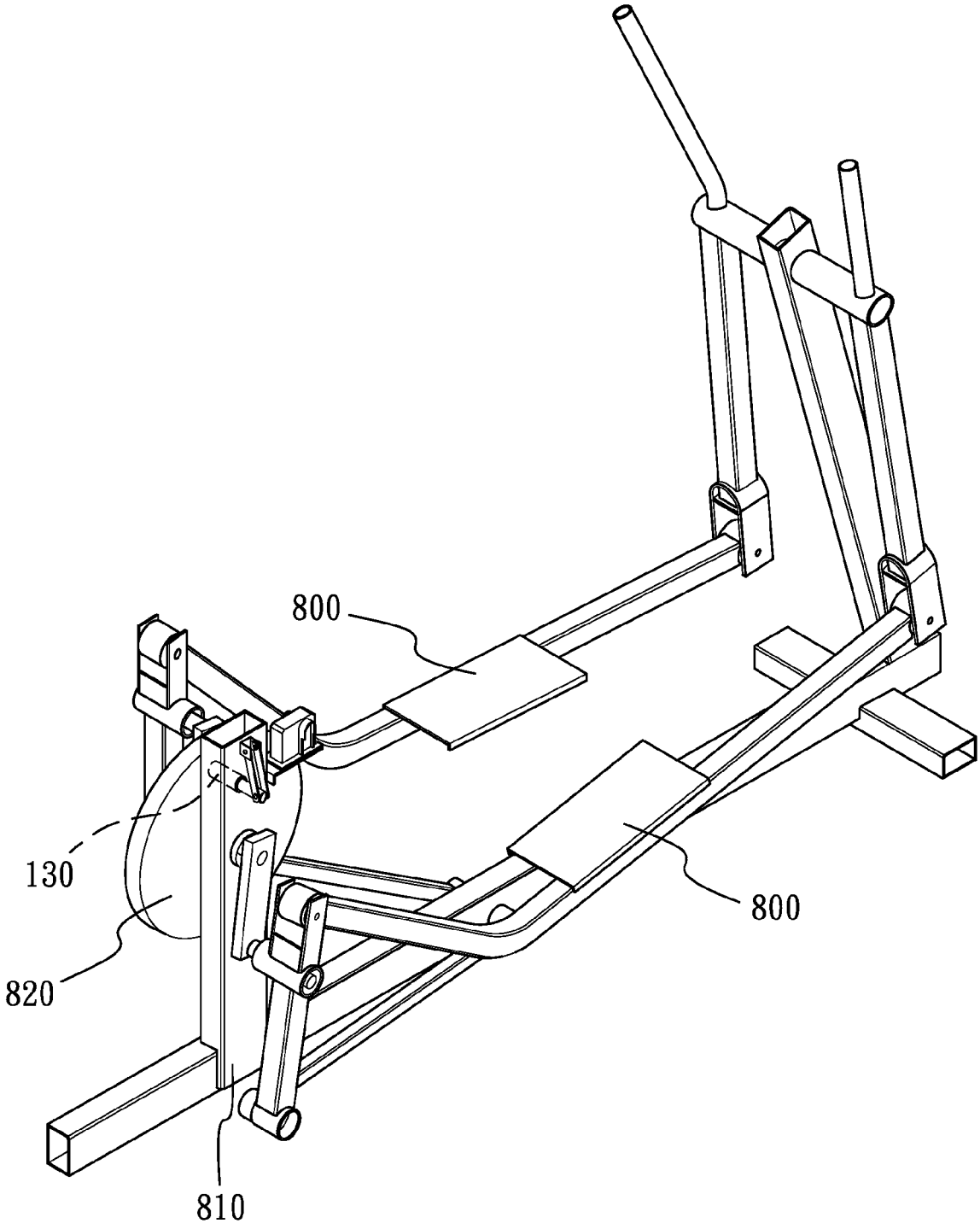
FIG. 8 is an applied perspective view, showing the safety device of FIG. 7 used in a rear-drive type elliptical exercise machine.

FIG. 8 is an applied view of the present disclosure, showing the safety device of FIG. 7 used in a rear-drive type elliptical exercise machine. As illustrated, the safety device is installed in a support 810 between two pedals 800, which are movable by a flywheel 820 (i.e., the aforesaid movable member 120), and the locking member 130 of the safety device is operable to lock and unlock the flywheel 820. Thus, when the user steps on the pedals 800 before starting to exercise, the user will not accidentally fall from the elliptical exercise machine due to an unexpected displacement of the center of gravity.

Figure 9:
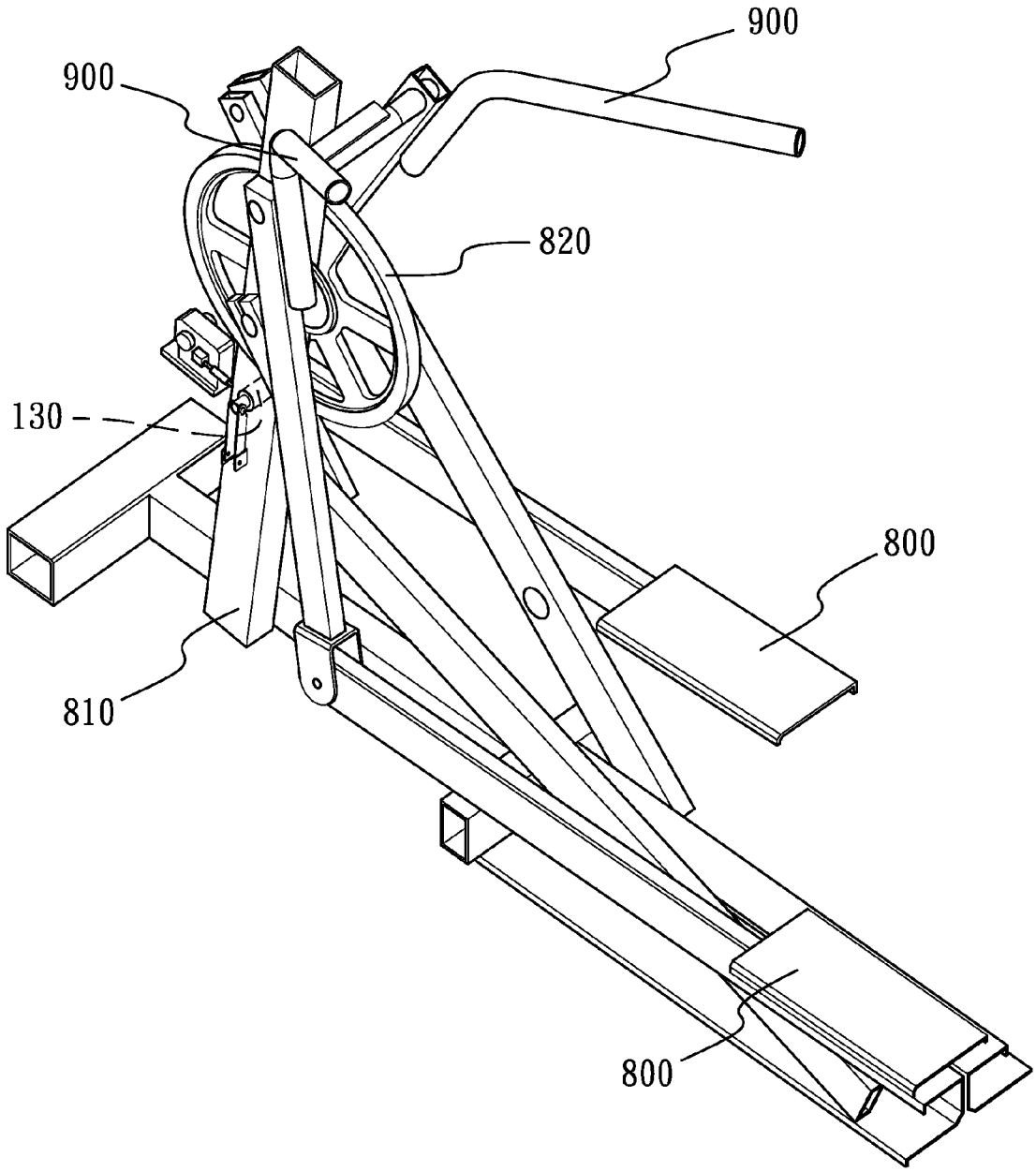
FIG. 9 is another applied perspective view showing the safety device of FIG. 7 used in a front-drive type elliptical exercise machine.

FIG. 9 is another applied view of the present disclosure, showing the safety device of FIG. 7 used in a front-drive type elliptical exercise machine. As illustrated, the safety device is installed in a support 810 between two handlebars 900 and two pedals 800 that are movable by a flywheel 820 (i.e., the aforesaid movable member 120), and the locking member 130 of the safety device is operable to lock and unlock the flywheel 820. Thus, when the user steps on the pedals 800 before starting to exercise, the user will not accidentally fall from the elliptical exercise machine due to an unexpected displacement of the center of gravity.

As stated above, the above described various embodiments of the present invention have the advantage that a user, after a use of the elliptical exercise machine, can lock the two pedals from movement so that when a subsequent user steps onto the pedals of the elliptical exercise machine, the subsequent user will not accidentally fall from the pedals of the elliptical exercise machine.

Although particular embodiments of the invention have been described in detail for purposes of illustration, various modifications and enhancements may be made without departing from the spirit and scope of the invention. In particular, a person having ordinary skill in the art will recognize that different features of different embodiments may be combined. Accordingly, the invention is not to be limited except as by the appended claims.

What is claimed is:

1. A safety device for use with an elliptical exercise machine, comprising:

a holder frame configured to be fixedly mounted in an elliptical exercise machine;

a movable member arranged to be movably mounted in an elliptical exercise machine;

a locking member movably mounted in said holder frame and adapted for locking said movable member; and an operating member having a first end and an opposed second end, the second end of said operating member connected with said locking member, the first end of said operating member pivotally connected with said holder frame; and wherein the second end of said operating member is rotatable about an axis of said the first end of said operating member for causing said operating member to move said locking member.

2. The safety device as claimed in claim 1, further comprising:

a rotating shaft arranged to be pivotally mounted in an elliptical exercise machine adjacent to said movable member and configured to be rotatable by an external force; and a connection member configured to be wound around said rotating shaft, said connection member having a first end thereof fixedly connected to said operating member and an opposed second end thereof fixedly connected to said rotating shaft.

3. The safety device as claimed in claim 2, further comprising an electric motor arranged to rotate said rotating shaft.

4. The safety device as claimed in claim 2, further comprising a manual control knob arranged to rotate said rotating shaft.

5. The safety device as claimed in claim 1, further comprising an actuation chamber defined in said holder frame and having an opening in communication with space outside said holder frame, wherein said locking member is movably mounted in said actuation chamber, having one end thereof movable through said opening of said actuation chamber.

6. The safety device as claimed in claim 1, wherein said movable member has at least one locating device for receiving one end of said locking member.

7. The safety device as claimed in claim 6, wherein said locating device is a groove; and said locking member is a rod member for engaging one said groove.

8. The safety device as claimed in claim 6, wherein said locating device is a pinhole; and said locking member is a pin member for engaging one said pinhole.

* * * * *